US006139369A

United States Patent [19]

Arwidi et al.

[11] Patent Number: 6,139,369

[45] Date of Patent: Oct. 31, 2000

[54] COAXIAL CONNECTOR FOR EQUIPMENT IN A TRANSMISSION NETWORK

[75] Inventors: Viktoria Arwidi, Stockholm; Ingela Blomberg, Skellefteå; Anders Forslund, Skellefteå; Tore Sjödin, Skellefteå, all of Sweden

[73] Assignee: Telefonaktiebolaget LM Ericsson, Stockholm, Sweden

[21] Appl. No.: 09/127,046

[22] Filed: Jul. 31, 1998

[30] Foreign Application Priority Data

Jul. 31, 1997 [SE] Sweden ..... 9702838

[51] Int. Cl.[7] ..... H01R 25/00

[52] U.S. Cl. ..... 439/638; 439/76.1; 439/638; 439/552; 439/554; 439/557; 439/944

[58] Field of Search ..... 439/188, 638, 439/944, 76.1, 675, 552, 554, 557, 350, 351, 352, 353, 354, 355, 356, 357, 358

[56] References Cited

U.S. PATENT DOCUMENTS

| | | | |
|---|---|---|---|
| 3,193,613 | 7/1965 | Buren, Jr. | 174/65 |
| 3,944,316 | 3/1976 | Newman et al. | 339/111 |
| 4,720,267 | 1/1988 | De Jong | 439/76 |
| 5,207,586 | 5/1993 | Macgregor et al. | 439/76 |
| 5,214,673 | 5/1993 | Morgenstern et al. . | |
| 5,348,491 | 9/1994 | Louwagie et al. . | |
| 5,382,173 | 1/1995 | Brown et al. | 439/188 |
| 5,413,494 | 5/1995 | Dewey et al. . | |
| 5,913,701 | 6/1999 | Olson et al. | 439/668 |

FOREIGN PATENT DOCUMENTS

| | | |
|---|---|---|
| 0 230 746 | 8/1987 | European Pat. Off. . |
| 0 380 210 | 8/1990 | European Pat. Off. . |
| 0 459 664 | 12/1991 | European Pat. Off. . |
| 0 485 245 | 5/1992 | European Pat. Off. . |

*Primary Examiner*—Paula Bradley
*Assistant Examiner*—Truc Nguyen
*Attorney, Agent, or Firm*—Burns, Doane, Swecker & Mathis, L.L.P.

[57] ABSTRACT

A coaxial connector for providing a terminal at a panel for equipment in a transmission network, comprising a housing with two housing halves with at least two connector passageways. At least two of the connector passageways are provided with connecting jack elements. The housing forms a U-link type connector which is adapted to be mounted in an aperture in said panel. The housing halves are made of an electrically conductive material and a holder of an insulating material is provided for mounting the connector in the aperture.

13 Claims, 3 Drawing Sheets

COAXIAL CONNECTOR FOR EQUIPMENT IN A TRANSMISSION NETWORK

This application claims priority under 35 U.S.C. §§ 119 and/or 365 to Application No. 9702838-5 filed in Sweden on Jul. 31, 1998; the entire content of which is hereby incorporated by reference.

BACKGROUND

The present invention relates to a coaxial connector for providing a terminal at a panel for equipment in a transmission network, comprising a housing with two housing halves with at least two connector passageways.

Coaxial connectors are for example used in a digital distribution field DDF, for connecting a digital multiplexor to an exchange terminal circuit. The conventional DDF is provided with panels each of which has a large number of jack/plug connectors. By interconnecting or cross connecting these connectors by means of jack-terminated coaxial cables at one side of the panel and by means of plug-terminated U-links at the other side of the panel, it is possible to redirect or break traffic routes, to take out signals at any desirable level, and to measure incoming and outgoing signals.

EP 0230746 discloses a coaxial jack device for use in transmission networks for telecommunications or broadcast applications. Due to the large number of different components that each of these jack/plug connectors are made up of, and the fact that high quality standards are required for all components to maintain trouble-free traffic flow, both manufacturing cost and installation time is high for the above described connectors.

SUMMARY

Thus, one of the objects of this invention is to enable reduced manufacturing cost for the above described type of connectors while improving or at least maintaining quality standards. Another object is to allow for a reduction in the installation time of these connectors.

According to the invention, this is accomplished by means of a connector wherein at least two of the connector passageways are provided with connecting jack elements, that the housing forms a U-link type connector which is adapted to be mounted in an aperture in said panel, that the housing halves are made of an electrically conductive material, and that a holder of an insulating material is provided for mounting the connector in the aperture. By configuring the connector as a U-link type connector which is provided with jack elements and adapting it to be mounted in the panel, without any jack/plug elements, the novel connector may perform several functions and will therefore reduce the number of required components. The connector according to the invention may be pre-assembled into a panel or rack for quick installation in the field. The invention also makes it possible to reduce the number of components in the connector and to facilitate its assembly into the panel. It also makes it possible to connect the jack elements electrically via the housing.

Preferably, the holder is produced of an elastic material, with snap-lock means for cooperation both with the connector housing and the panel aperture. This makes it possible to assemble the connector without screws or any similar fastening means. Also, the holder may be provided with snap-lock means for securing plugs inside the passageways.

According to another embodiment of the invention, the housing halves are provided with accommodation for a circuit board element. This element may preferably be located in a plane which is substantially perpendicular to the parting line of the housing halves.

The circuit board element may be provided with protruding center contacts for two parallel connector passageways and these contacts may be connected by means of a conductive printed layer of said element. The circuit board element provides cost-efficient locating and conductive functions for the center contacts within the housing.

According to a special embodiment of the invention, the housing is provided with a third connector passageway with a connecting jack element, which connector passageway provides a measuring jack.

In this embodiment, the opposite side of the circuit board element may be provided with a protruding center contact which is connected to the conductive printed layer via a surface-mounted resistor element.

In any embodiment of the coaxial connector according to the invention, the two housing halves are preferably symmetrical. Also, each center contact may be provided with a cylindrical insulator.

The two housing halves may be provided with friction coupling pins for holding the housing halves together. The holder and a nut may also contribute for holding said halves together.

BRIEF DESCRIPTION OF THE DRAWINGS

The invention will in the following be further described in a non-limiting way under reference to the accompanying drawings in which.

DETAILED DESCRIPTION

Figure 1:
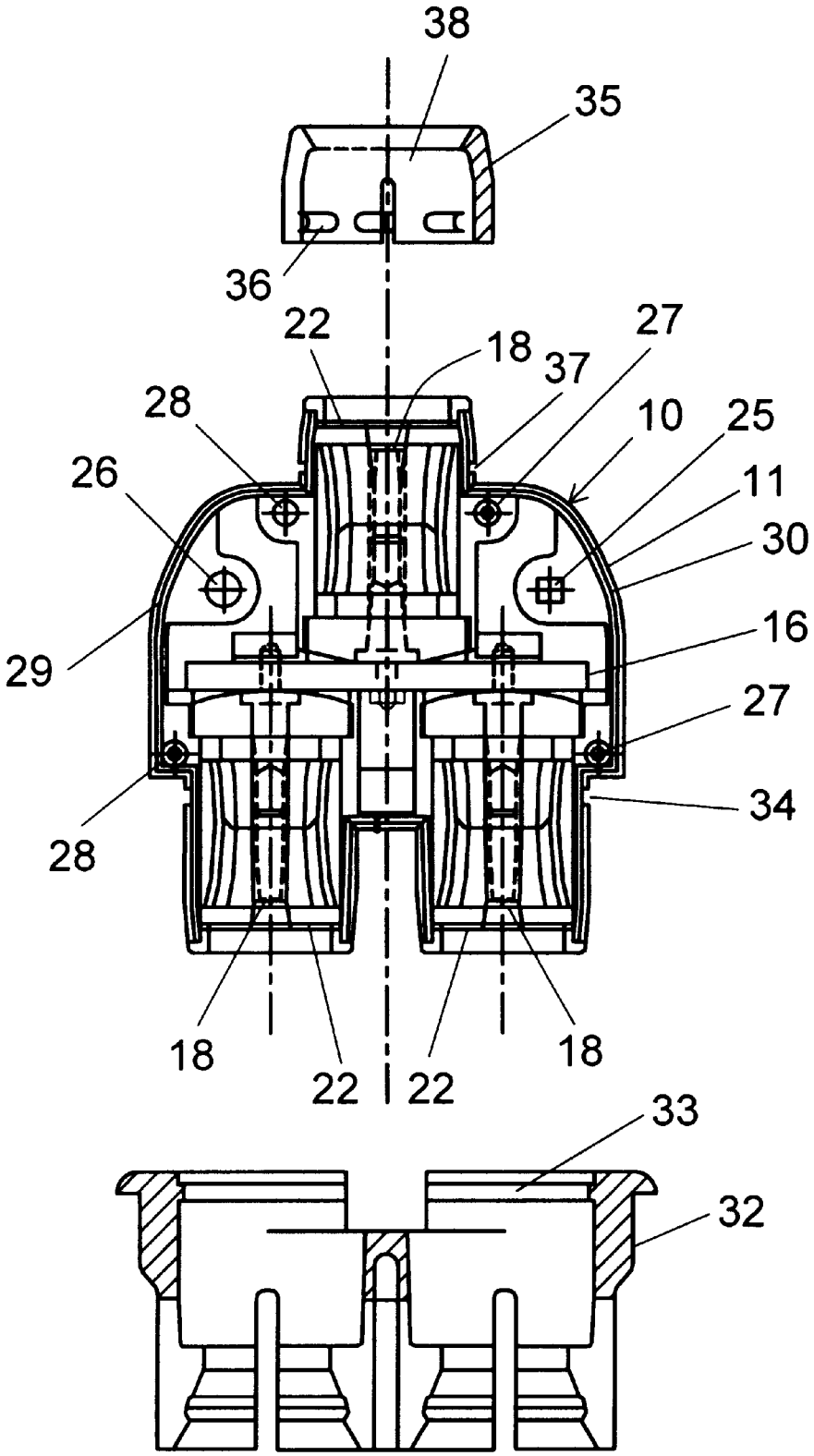
FIG. 1 is an enlarged plane view showing a U-link connector housing half with internal and external components, in accordance with the invention.
Figure 2:
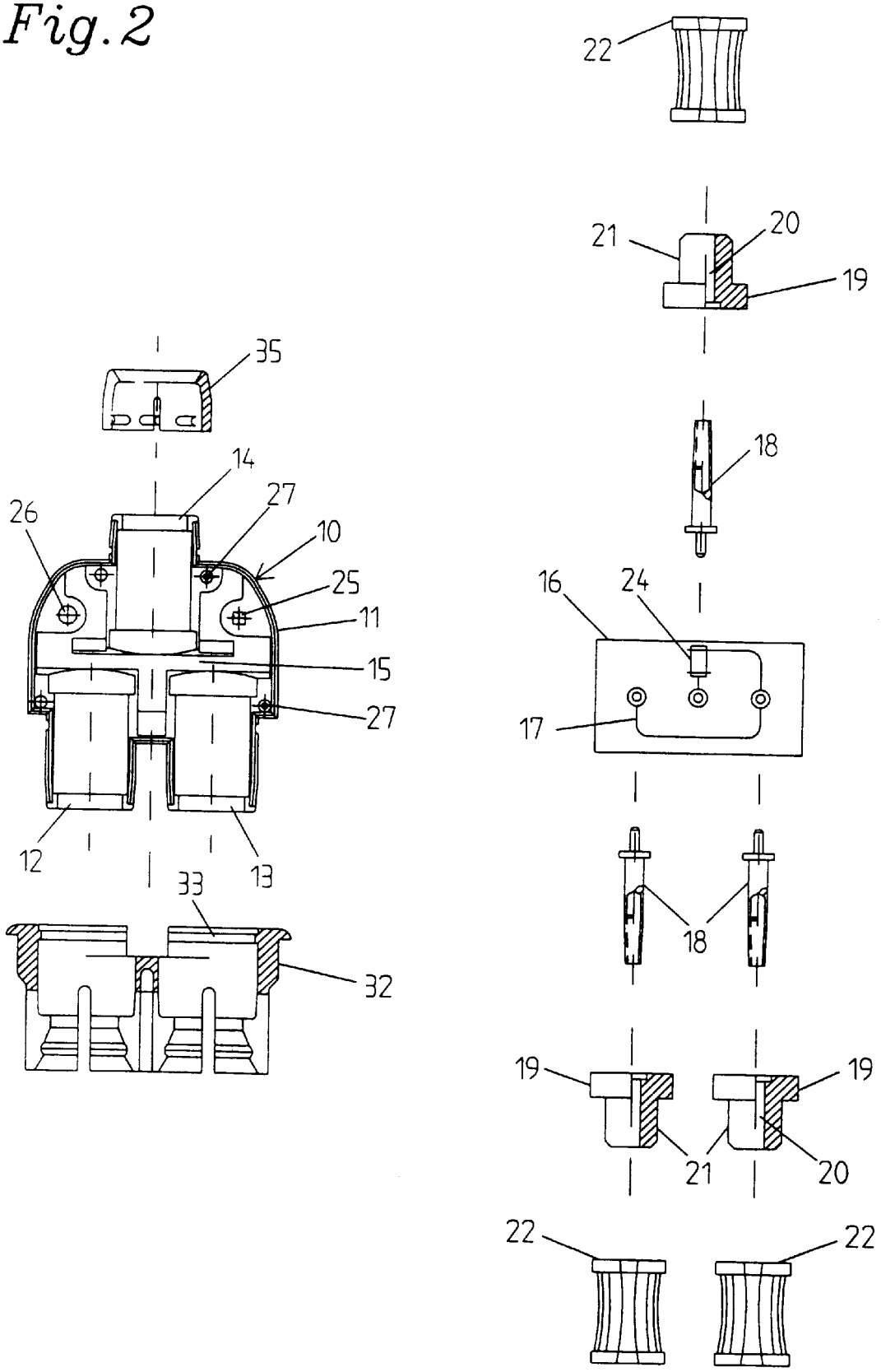
FIG. 2 is a corresponding view in smaller scale with the internal components shown in an exploded manner.

The coaxial connector in accordance with the invention is configured as a U-link type connector, comprising a housing 10 with two symmetrically and identically shaped housing halves 11. The housing is provided with three connector passageways 12-14, which are all arranged in the same plane, but two of the passages 12, 13 are arranged in parallel, facing the same direction. The third passage 14 faces into the opposite direction.

The housing halves have been cast from a metal, e.g. a corrosion resistant alloy, by means of identical cast molds. The three passageways 12–14 are identical and located so that there is a small distance between the walls that define the ends of the passageways, defining a slot-shaped accommodation space 15 within the center of the housing.

The accommodation space 15 is adapted to hold a small circuit board element 16 in a plane which is perpendicular to the plane of the passageways. The element 16 is provided with a printed, electrically conductive layer path 17 which is arranged so that it is well insulated from the adjacent parts of the electrically conductive housing 10. The element 16 forms a mechanically rigid carrier for the center contacts 18 which are rigidly mounted on the element, perpendicular to the plane of said element, so that they are positioned in the center of each passageway when the element is located in its slot 15 in the housing. Cylindrical insulators 19 are provided with through holes 20, which are just large enough so that the center contacts 18 can pass through them when the connector housing is assembled.

Each insulator 19 centers the corresponding center contact 18 inside the passageway and is also longitudinally held in position by means of its lateral end walls. Each insulator 19 is also provided with an axially protruding part 21 of smaller diameter which projects into the respective passageway and halfway into one end of an elastic jack element 22.

Figure 3:
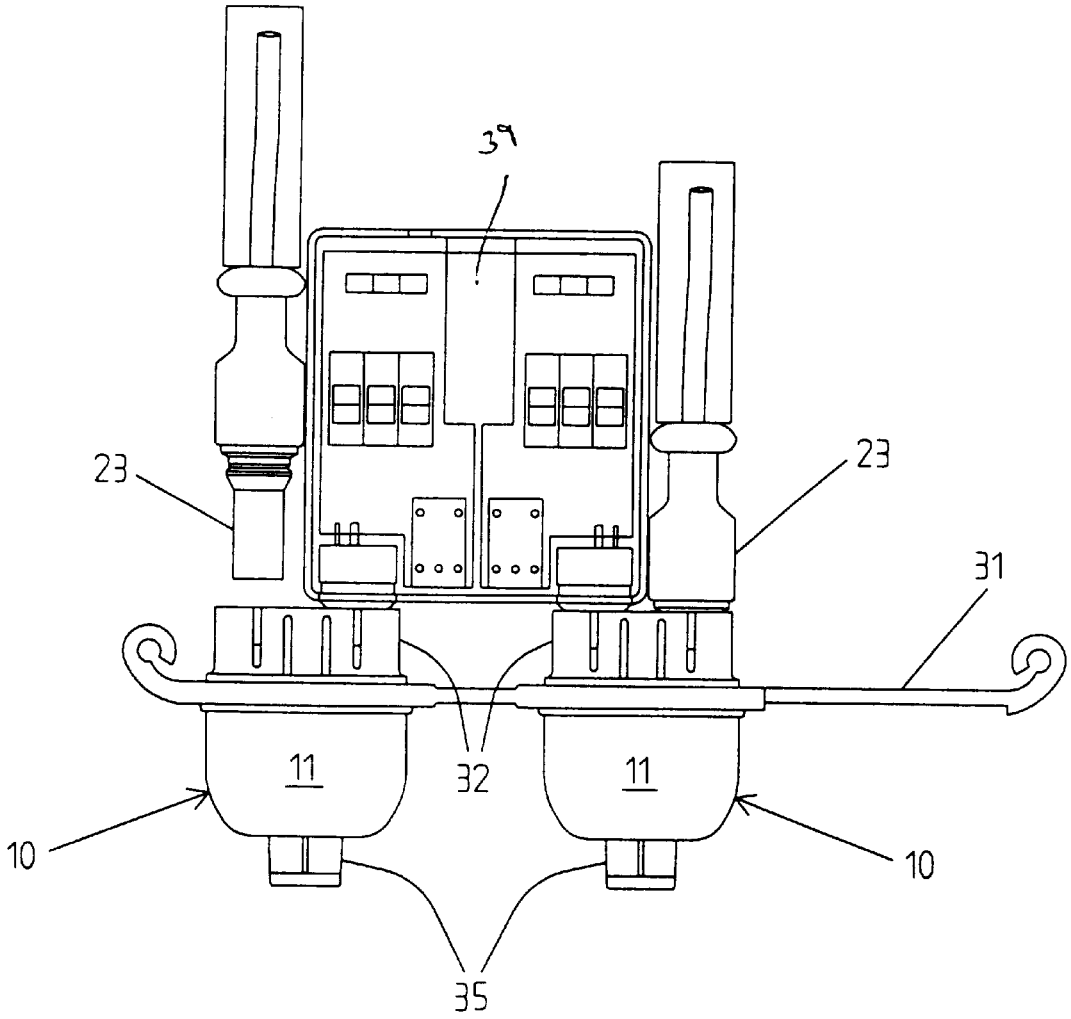
FIG. 3 shows two connectors according to the invention mounted in a panel interconnected by means of a balun.

The two jack elements 22 located inside the passageways 12, 13 provide a friction coupling for the tubular end of a coaxial plug 23, see FIG. 3. The jack elements also provide electrical connection between said plug end and the connector housing. The correspondingly equipped third passageway 14 provides a measuring jack for measuring incoming and outgoing signals. For this object, the third center contact 18 is electrically connected to the conductive printed layer 17 via a surface mounted resistor 24.

The two halves 11 of the housing 10 are preferably held together by means of a friction coupling, provided via a projecting pin 25 on each of the housing halves which pin is insertable into a corresponding hole 26 in the matching housing half. This friction coupling may be assured by riveting. The indexing of the housing halves is further guaranteed by means of two smaller indexing pins 27 in each housing half which fit into corresponding indexing cavities 28. Another measure for securing correct indexing of the two halves is a V-shaped ridge 29 which fits into a corresponding groove 30 to form a kind of labyrinth seal against penetration of dust particles and moisture into the connector.

The double passageway end of the connector is adapted for mounting into an aperture in a panel or rack 31 (see FIG. 3). For this object, a holder 32 of an insulating material is provided which insulates the holder from the metal panel. The holder is provided with snap-lock means 33 in the form a ridge which is able to snap into a groove 34 in the connector housing 10. Other snap-lock means in the form of flexible locking tongues (not shown in the drawing) cooperate with the panel aperture to secure the connector inside the aperture. The holder 32 is also provided with flexible locking tongues for securing plugs 23 inside the passageways 12, 13.

The single passageway end of the connector is adapted for mounting a plastic nut 35 which is provided with ridge means 36 for snapping into a groove 37 around the outside of the passageway 14. The plastic nut 35 may be provided with an aperture 38 for insertion of a measuring plug, if the connector is configured as a measuring U-link jack, or the plastic plug may be closed, if the connector is configured as a normal U-link jack. In this type of configuration, the jack element 22, the insulator 21, the center contact 18 and the resistor element 24 of the passageway 14 may be omitted.

In FIG. 3, two coaxial U-link jack connectors in accordance with the invention are shown mounted into a panel 31 interconnected via a balun (balanced-to-unbalanced transformer) 39. Two plugs 23 connect the balun to line.

The invention is not limited to the above described embodiment, but several modifications are possible within the scope of the accompanying claims. For example, the housing 10 may be designed differently than what is shown, and the circuit board element 16 may be replaced with some other holder for the center contacts.

We claim:

1. A coaxial connector for providing a terminal at a panel for equipment in a transmission network, comprising a housing with two housing halves with at least two connector passageways, wherein:

at least two of the connector passageways are provided with connecting jack elements, the housing forms a U-link type connector which is adapted to be mounted in an aperture in said panel, the housing halves are made of an electrically conductive material, and a holder of an insulating material is provided for mounting the connector in the aperture, wherein the holder is produced of an elastic material with snap-lock means for cooperation both with the connector housing and the panel aperture, and wherein the holder is also provided with snap-lock means for securing plugs inside the passageways.

2. A coaxial connector according to claim 1, wherein the jack elements are electrically connected via the housing.

3. A coaxial connector according to claim 1, wherein the housing is provided with accommodation for a circuit board element.

4. A coaxial connector according to claim 3, wherein the circuit board element is located in a plane which is substantially perpendicular to a parting line of the housing halves.

5. A coaxial connector according to claim 4, wherein one side of the circuit board element is provided with protruding center contacts for two parallel connector passageways.

6. A coaxial connector according to claim 5, wherein the center contacts of the circuit board element are connected by means of a conductive printed layer of said element.

7. A coaxial connector according to claim 1, wherein the housing is provided with a third connector passageway with a connecting jack element, said third connector passageway providing a measuring jack.

8. A coaxial connector according to claim 1, wherein the opposite side of the circuit board element is provided with a protruding center contact which is connected to the conductive printed layer via a surface-mounted resistor element.

9. A coaxial connector according to claim 1, wherein the two housing halves are symmetrical.

10. A coaxial connector according to claim 1, wherein each center contact is provided with a cylindrical insulator.

11. A coaxial connector according to claim 9, wherein the two housing halves are provided with friction coupling pins for holding said halves together.

12. A coaxial connector according to claim 11, wherein the holder also contributes for holding said halves together.

13. A coaxial connector according to claim 11, wherein a nut also contributes for holding said halves together.

* * * * *